US005767963A

United States Patent [19]

Berger

[11] Patent Number: 5,767,963

[45] Date of Patent: Jun. 16, 1998

[54] METHOD AND APPARATUS OF DETECTING A YARN LAP ON A ROTATING ROLL

[75] Inventor: Gerald Berger, Wupperta, Germany

[73] Assignee: Barmag AG, Remscheid, Germany

[21] Appl. No.: 682,583

[22] PCT Filed: Nov. 22, 1995

[86] PCT No.: PCT/DE95/01625

§ 371 Date: Sep. 16, 1996

§ 102(e) Date: Sep. 16, 1996

[87] PCT Pub. No.: WO96/15969

PCT Pub. Date: May 30, 1996

[30] Foreign Application Priority Data

Nov. 23, 1994 [DE] Germany ..... 44 41 736.5

[51] Int. Cl.[6] ..... G01N 21/00; G01N 21/84; B65H 63/00; B23Q 15/00

[52] U.S. Cl. ..... 356/238; 356/430; 250/559.4; 242/36; 226/10; 226/45

[58] Field of Search ..... 356/429–431, 356/238, 426; 250/559.39–559.48; 242/36; 226/10, 45

[56] References Cited

U.S. PATENT DOCUMENTS

| | | | |
|---|---|---|---|
| 3,712,743 | 1/1973 | Harris et al. | 356/430 |
| 4,108,708 | 8/1978 | Gregory et al. | 356/238 |
| 4,188,545 | 2/1980 | McClean et al. | 250/559.4 |
| 4,866,289 | 9/1989 | Kawamura et al. | 356/238 |
| 5,029,762 | 7/1991 | Behrens et al. | 242/18 A |
| 5,420,439 | 5/1995 | Landwehrkamp et al. | 356/238 |
| 5,590,547 | 1/1997 | Couzelmann | 242/47.01 |

FOREIGN PATENT DOCUMENTS

| | | |
|---|---|---|
| 072 935 | 3/1983 | European Pat. Off. . |
| 885 908 | 6/1953 | Germany . |
| 26 28 994 | 2/1977 | Germany . |
| WO89/07672 | 8/1989 | WIPO . |

*Primary Examiner*—Frank G. Font
*Assistant Examiner*—Jason Vierra Eisenberg
*Attorney, Agent, or Firm*—Bell Seltzer Intellectual Property Law Group of Alston & Bird LLP

[57] ABSTRACT

The invention relates to a method and an apparatus for detecting a yarn wind on a rotating roll partially looped by the yarn and associated with a yarn processing apparatus, and which includes a light source for directing to the monitoring range of the roll a light beam, which is imaged as a light strip along a surface line of the roll, and a light sensor with an evaluation device. The sensor detects the light reflected from a yarn wind, which is converted into an electric signal and may then be further processed.

17 Claims, 3 Drawing Sheets

METHOD AND APPARATUS OF DETECTING A YARN LAP ON A ROTATING ROLL

BACKGROUND OF THE INVENTION

The invention relates to a method of detecting a yarn wind (or lap) on a rotating roll, as well as to a device for carrying out this method.

It is known to determine the diameter of a package, in particular a package of a synthetic yarn, by means of a pivotally arranged sensor roll. To this end, the sensor roll rests against the package being wound and rotates along with same. Should an interference with the yarn occur in the region of the sensor roll, the yarn may be wound on the sensor roll. Such an unwanted yarn wind leads to a breakdown of the operation. The breakdown may also lead to a malfunction of a yarn traversing mechanism upstream of the winding head or takeup unit, and cause, within a short period of time, considerable damage to the yarn takeup unit as a result of a rapidly increasing volume of the yarn winds on the sensor roll.

To minimize the extent of the breakdown in the operation and damage, it has been proposed already to provide a sensor plate tangential to the sensor roll. Since the sensor roll vibrates, it is necessary to provide an air gap between the sensor roll and the sensor plate. To make sure that the sensor plate does not trigger false alarms under all operating conditions, the air gap must be made accordingly large. This leads to the disadvantage that a noticeable amount of yarn winds must have formed on the sensor roll, so that the sensor plate releases an alarm signal.

With respect thereto, it has already been proposed to provide a light barrier, which is arranged parallel to the sensor roll of the takeup unit. Should now a yarn wind about the sensor roll, the amount of light received is changed by the lap. Should this amount fall below a predetermined value (photocurrent), an alarm signal will be released.

However, this solution fails to take into account that the sensor roll vibrates. The vibrations of the sensor roll develop as a result of radial oscillations, which result from inaccuracies of roundness, as well as from bendings or from pressure on the yarn packages. Likewise, such vibrations may result from a play in the bearing, transfer of imbalance and vibration by yarn packages resting thereagainst.

As a result, even this solution fails to provide a satisfactory monitoring of the sensor roll or contact roll.

Finally, for purposes of monitoring selected axial portions of a rotating contact roll or sensor roll with respect to yarn winds, it is known from U.S. Pat. No. 4,188,545 to direct from a source of light arranged at a radial distance above the roll, a light beam to a monitoring range of the roll at an angle from 0° to 90° , to capture the reflected light by a light-sensitive sensor, and to convert same into an electric signal. Changes in the intensity of the reflected light or the stray light caused by an undesired wind are measured, evaluated, and used for actuating a yarn cutting device.

Disadvantageous in the known method, which forms the basis of the invention, is that the monitoring range is substantially punctiform, and that the entire length of the roll of the takeup unit can be monitored only with a large amount of technical resources. However, this is necessary, should an undesired yarn wind or lap form, for example, in the instance of a shut down traversing mechanism, on a section of the shaft that is not monitored. It is possible, though, to even detect such undesired yarn winds with the use of a plurality of light sources and detector arrangements, which extend along the roll, or, in the alternative, by reciprocating the light source and the light-sensitive sensor arrangement. However, this causes the time of response of the system to become extremely long, and makes the monitoring method unsuitable for high winding speeds. In addition, along with a contamination of the roll surface, the reflection properties deteriorate, and a stable adjustment of the operating point is made difficult, thereby limiting considerably the operational reliability of the known device.

It is therefore the object of the present invention to describe a method for an early detection of an undesired yarn wind at any location of the monitoring range of a rotating roll in a yarn processing machine or yarn takeup apparatus, which operates safely and reliably. Furthermore, it is the object to describe a device, which permits a yarn winding on a roll of such a machine or apparatus to be detected with a high operational reliability and within a short time of response.

SUMMARY OF THE INVENTION

The above and other objects and advantages of the present invention are achieved by the provision of a method and apparatus which comprises a roll mounted for rotation about its axis, means for guiding an advancing yarn so as to advance across the surface of the rotating roll, and a light source for directing a light beam at an acute angle with respect to the surface of the roll. The light beam has a cross section so as to define a monitoring range on the surface of the roll which is composed of a narrow light strip which extends axially along a portion of the surface of the rotating roll which is not looped by the advancing yarn, and such that the light beam is reflected from the monitoring range along a predetermined path. Also, a light sensor is positioned at a location outside of the light beam and outside of the predetermined path of the reflected light and so as to sense stray light which is reflected from a yarn lap formed on the roll.

The method is based on the following train of thought: A preferably substantially vertical arrangement of the light sensor with respect to the monitoring range of the roll precludes radial vibrations of the roll from affecting the detection of the yarn. This allows to detect, under circumstances, already a single yarn wind on the roll. However, the light sensor may also be arranged in other regions. The measure of directing a light beam that arrives at a grazing angle, extends parallel, or flares out, has in particular the advantage that the entire monitoring range, which is defined between two spaced-apart normal planes of the roll, is illuminated by a single source of light and an optical imaging system associated thereto, when the angle of incidence $\alpha$ is adjusted correctly relative to the jacket surface of the roll. This angle is dependent on the amplitude of the vibrations of the roll during the winding operation, the tolerances in the manufacture of the roll, and the height of thrust rings that may be present on the roll. This angle of incidence $\alpha$ is in a range from 3° to 10°, preferably 5°, and is determined in the individual case by test based on constructional conditions. Consequently, the detection of an undesired yarn wind or lap occurs simultaneously in the entire monitoring range, whereas the prior art permitted only a punctiform detection by successive measurements. The detection of the yarn occurs in that the yarn which consists of a plurality of filaments, reflects light and virtually flashes on the roll of the yarn takeup unit. This flashing is detected by the evaluation device as a stray light, whereupon a signal is released. Therefore, the illumination of the sensor roll over the entire monitoring range with a light beam arriving at a grazing angle of incidence ensures that a flashing of the yarn occurs, already when one or few winds are present, since the roll itself reflects only little light in direction of the light sensor and, therefore, the incident stray light is detected as a deviation from a possibly existing, normal radiation.

Preferably, the light is monochromatic. The roll may be radiated, for example, by means of a source of laser light. While this source is not necessary, it has however the advantage that possibly needed lens systems of the optical imaging system may be laid out in a simpler manner, since the monochromatic light has a uniform wave length, and corrections on the lenses need to be considered only for this uniform wave length. Likewise, it is simpler to eliminate, with the use of filters, interferences caused by external influences of the daylight or ambient light. Preferably, a source of laser light is a cost-favorable possibility of producing a sharply defined beam of a monochromatic light. Preferred for the present invention are electronic sources of laser light, which operate in wave length ranges close to infrared.

Known rolls of yarn takeup systems have several raised, axially spaced-apart thrust rings, so as to adjust during a package doff favorable speed conditions for threading or transferring a yarn. To ensure that unilluminated ranges are absent next to the thrust rings, and that yarn winds forming in the "shadow" of the thrust rings are likewise detected, it is proposed in one embodiment of the invention to radiate the roll by two sources of light arranged substantially in one plane and facing one another at a axial distance, and to illuminate in this manner the entire monitoring range, even directly adjacent to the thrust rings. In this embodiment, the light sensor is positioned at a location outside of both light beams and their reflected beams, and preferably it is positioned above the center of the monitoring range of the roll.

It should be remarked that the roll may also be the yarn feed roll or yarn withdrawal roll (godet) of a filament yarn spinning machine. Preferably, however, it is the contact roll or sensor roll of a yarn takeup unit in such a machine for spinning synthetic filament yarns, which has a basic design and construction as is known, for example, from U.S. Pat. No. 5,029,762.

To detect a yarn wind on a rotating roll of a yarn takeup unit, an arrangement is proposed which includes an optoelectrical arrangement (light sensor). In a preferred embodiment, this optoelectrical arrangement is positioned substantially in the center above the monitoring range and, at a distance, on the side of the roll, which is not looped by the yarn, as well as an evaluation device which releases a signal. Preferably, the optoelectrical arrangement is electrically connected with the evaluation device.

The optoelectrical arrangement detects the light reflected by a yarn wind on the rotating roll and converts same to a preferably stationary electric signal that is to be supplied to the evaluation device. A further signal is released by the evaluation device, when a tolerance limit is exceeded, the signal being an alarm signal or a signal for cutting the yarn.

In particular, however, the arrangement comprises a light source arranged outside of the monitoring range, which directs a light beam to the roll in the axial direction thereof and at a small angle of incidence relative to the roll. Preferably, the light source emits a monochromatic light, for example, the light from a source of laser light. The light may be, for example, a light beam that is cross sectionally rectangular or adapted to the monitoring range and widened with a suitable optical system.

Preferably, the optoelectrical arrangement comprises an optical imaging system with a light sensor arranged behind a convergent lens. The light sensor may be a CCD array or a photodiode.

The use of a light sensor in the form of a CCD array has the advantage that same may be laid out corresponding to the timing signal. The knowledge of the axial position of the thrust rings on a roll, in particular a sensor roll of a yarn takeup unit makes it easy to gate out the measured values of the light sensor (undesired reflections) from this range with the use of a digital logic. The electronics enables a fast response to errors which may be in the range of milliseconds.

BRIEF DESCRIPTION OF THE DRAWINGS

Further advantages and characteristics of the method and the device are described with reference to an embodiment illustrated in the drawing, in which.

DETAILED DESCRIPTION OF THE PREFERRED EMBODIMENTS

Figure 1:
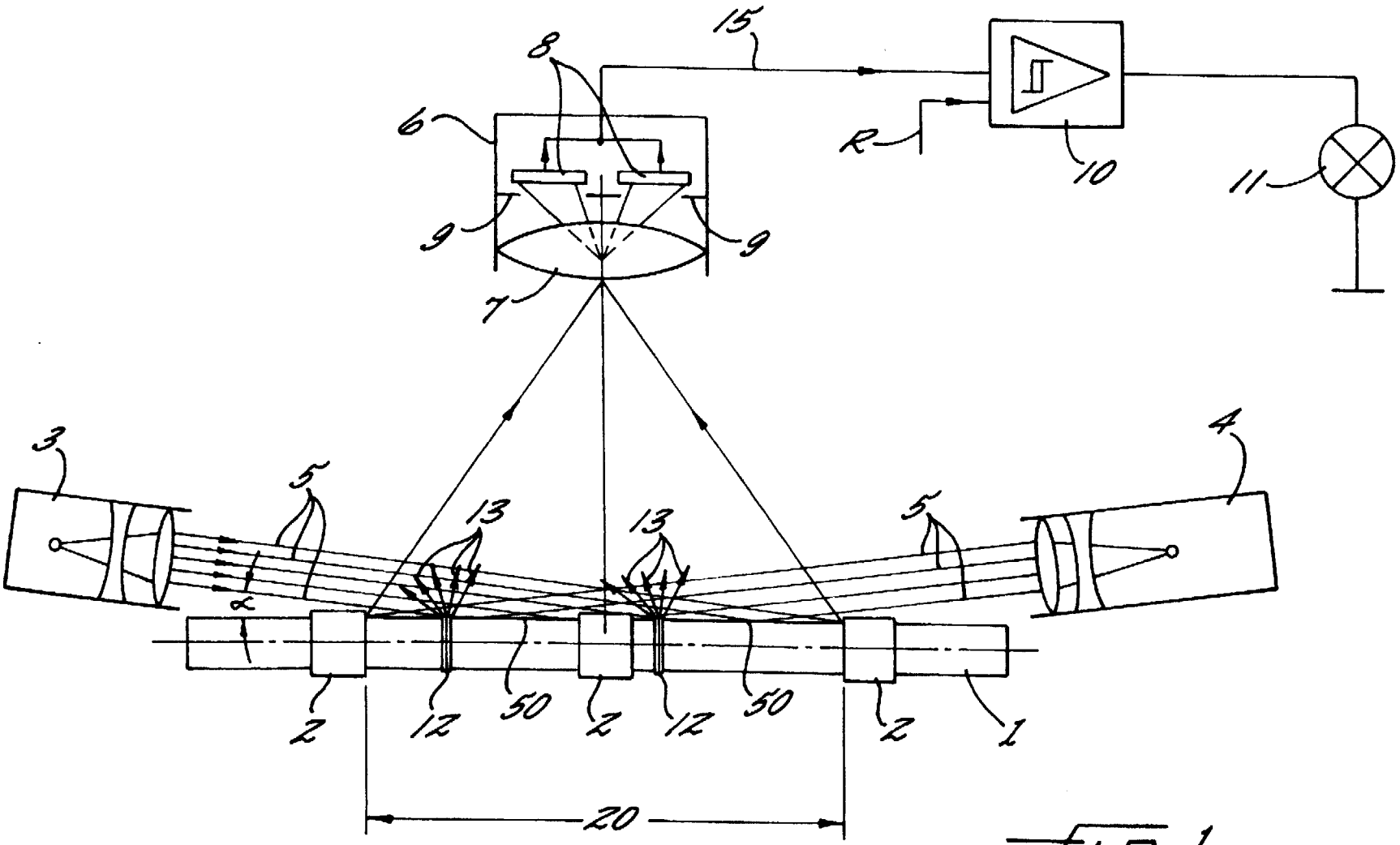
FIG. 1 shows a schematic arrangement of a sensor roll of a winding head with a device for monitoring laps.

On a shaft or sensor roll 1, which has, for example, a diameter of 85 mm, a plurality of thrust rings 2 are formed. After a package doff, same may come into contact with winding tubes that are clamped on a shaft of a chuck not shown.

The sensor roll 1 is radiated by means of two light sources 3, 4 arranged at a distance from the sensor roll and facing one another in a radial plane. The angle of incidence $\alpha$, at which a light beam or pencil of rays 5 arrives at the sensor roll, is selected so acute as to illuminate each region of the side of a monitoring range facing an optoelectrical arrangement (light sensor) 6–8. The light sources 3, 4 emit a cross sectionally rectangular light beam 5 having a width of about 10 mm and a depth of few millimeters, preferably one millimeter. This is realized, for example, by a collimated optical system not shown, which comprises cylindrical lenses. In the monitoring range of roll 1, the light beam 5 is projected on the roll respectively as a line or, in the peripheral direction of the roll, as a very narrow strip of light 50 extending along a surface line. To illuminate the entire monitoring range 20 which is formed between two spaced-apart normal planes of roll 1, the light sources 3, 4 are arranged laterally outside of monitoring range 20.

Arranged substantially vertically to the axis of rotation of sensor roll 1, at a distance therefrom, is an optoelectrical arrangement (light sensor) 6–8, which is located substantially in the center above the monitoring range 20 of roll 1. The arrangement comprises a convergent lens 7 followed by a light sensor 8. The light sensor 8 consists of photodiodes, which convert the incident light into a photocurrent 15. A mask 9, which gates out the region of thrust rings 2, precedes light sensor 8.

The light sensor 8 is electrically connected with an evaluation device 10, and same with an alarm display 11.

If a yarn advancing at a speed of 8000 m/min loops about sensor roll 1 and forms a lap 12, same will reflect the light emitted from light sources 3, 4. Furthermore, rays of light beam 5 are diffracted on the fine capillaries of the filament yarns. The reflected light 13 passes through convergent lens 7 to arrive at light sensor 8. Same emits a signal 15 to evaluation device 10, which is compared with a signal R that corresponds to a desired state. Should a comparison result in a deviation, which exceeds an acceptable tolerance range, the evaluation device will release an alarm signal.

The present invention permits to detect very early an undesired winding of a yarn on a sensor roll 1 over the entire length of monitoring range 20, in particular, already after one or few loopings, so that a cutting of the yarn can be released, before consequential damage occurs in the takeup machine.

The photodiodes allow to attain very short response times. Response times of one microsecond can be realized. The actual time of response depends on the amount of light that is reflected from yarn winds 12. Therefore, the angle of incidence $\alpha$ and the width of the light beam 5 directed to roll 1 ought to be kept respectively as small as possible, for example 5° or less, and narrower than 1 mm.

With the use of a CCD sensor, which consists of 1024 pixels and operates at a timing frequency of 15 Megahertz, a maximum time of response of 70 microseconds may be expected.

The response times of both possible light sensors are clearly less than 2 milliseconds. At winding speeds of 8000 m/min and with a sensor roll diameter of 85 mm, this time of reaction suffices to avoid consequential damage to endangered components of the takeup unit.

Figure 2:
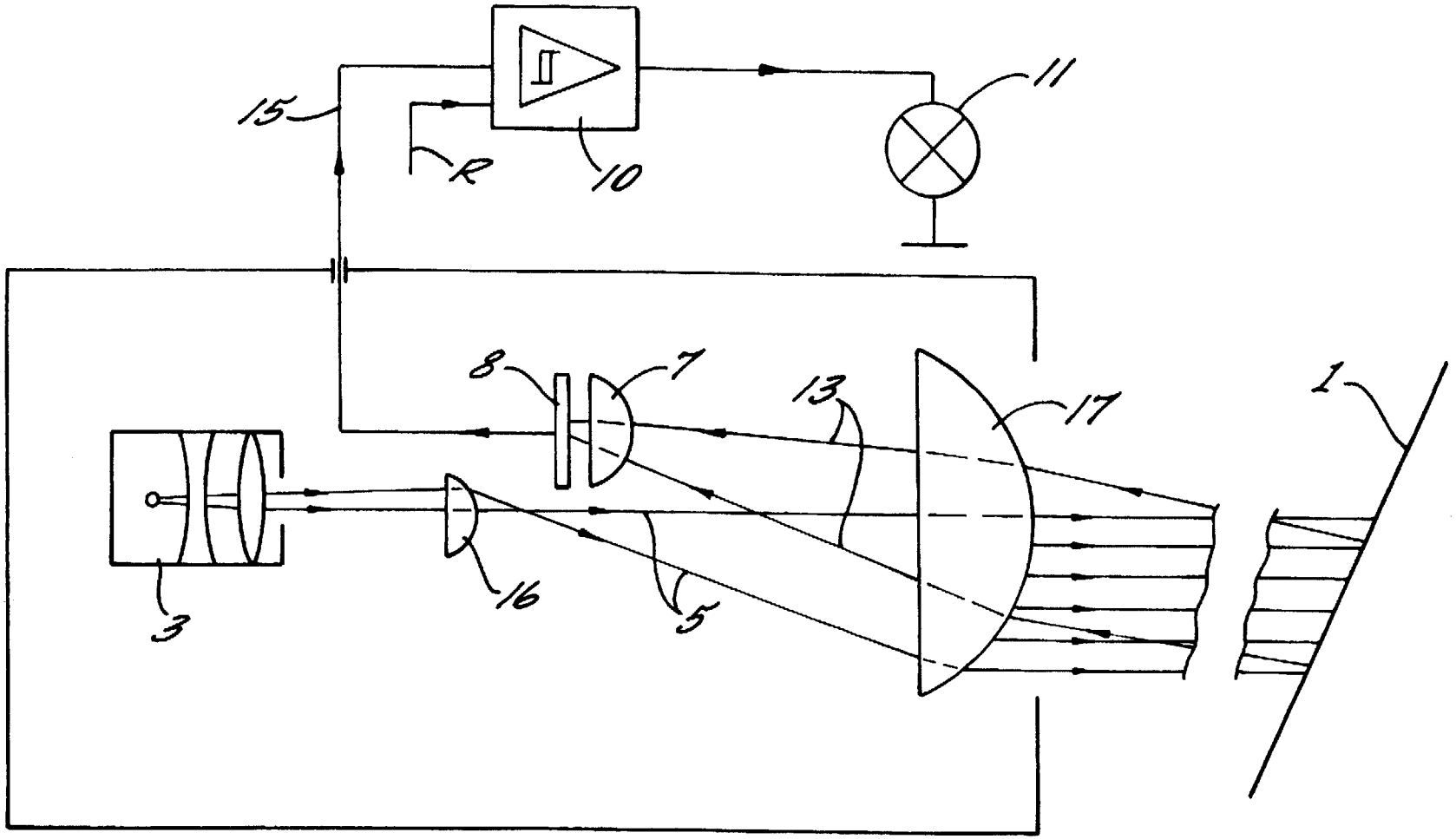
FIG. 2 shows a modified device in accordance with FIG. 1 with a different arrangement of the light sensor.

FIG. 2 illustrates a modified device for monitoring laps in accordance with FIG. 1. In this embodiment, imaging occurs from the perspective of incident light beam 5, which is projected from light source 3, via an optical arrangement comprising lenses 16, 17, on sensor roll 1 not shown in detail. The reflected light 13 is deflected by the convex surface of lens 17 and imaged on optoelectrical evaluation arrangement (light sensor) 7–8, which is arranged in the path of reflected light rays 13, and detects and converts same into a photocurrent 15. As in FIG. 1, same is supplied to evaluation device 10 and compared therein with a signal R, which corresponds to the photocurrent 15 having the intensity of the light reflected from a sensor roll 1 without a yarn wind. Subsequently, the difference signal is amplified in evaluation device 10, and may actuate an alarm device 11 or the like, when a predeterminable threshold value is exceeded.

The advantage of the arrangement in accordance with FIG. 2 is that components of the monitoring device need not be located in direct vicinity of the sensor roll 1 being monitored, so that the engineer has more freedom with respect to accommodating, assembling, and maintaining the light source 3 (emitter) and light sensor 7, 8 (receiver), as well as the optical components located therebetween.

However, it should be noted that, in the presence of a second light source for illuminating the entire monitoring region and for avoiding shadows next to optional thrust rings, the two light sources 3, 4 should be arranged in parallel planes that are offset from one another, so as to avoid a direct radiation of the light reflected from the sensor roll surface on the opposite light sensor.

Figure 3:
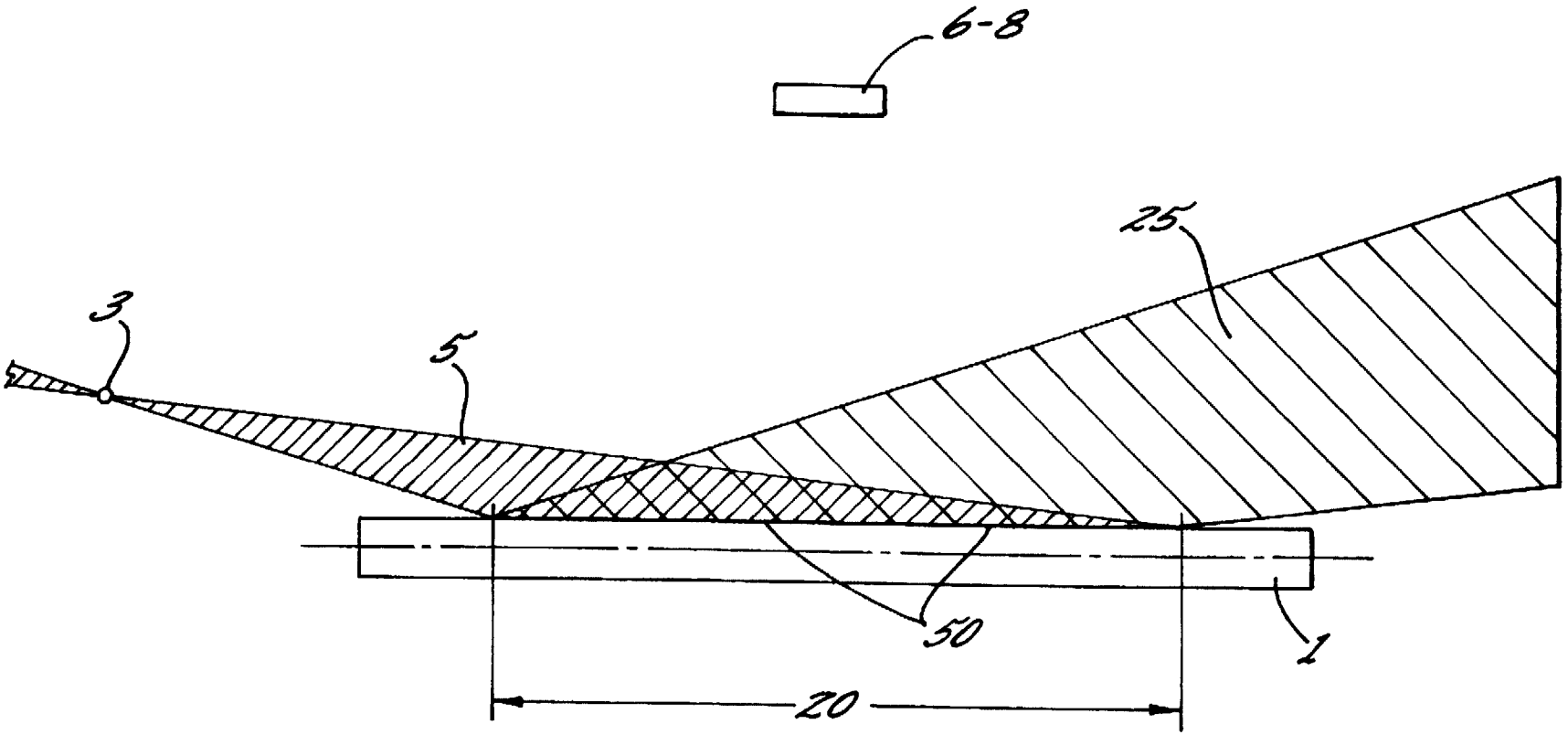
FIG. 3 shows the light beam directed from a light source to a surface line of the roll and reflected from the roll in a radial plane of the roll.

Finally, FIG. 3 shows in a schematic arrangement in a radial plane of roll 1 without thrust rings, by way of example, the position of light source 3 relative to roll 1, namely outside of the monitoring range 20 of this roll. Likewise, it shows the association of light sensor 6–8 for detecting the stray light produced on a possible yarn wind 12 in monitoring range 20. This stray light results from reflection, diffraction, and refraction of incident light beam 5 on the fine filaments (capillary filaments) of the yarn wind, which are predominantly opaque. In an arrangement as in FIG. 3, the light sensor 6–8 may be positioned on the side of roll 1, which is above roll 1, i.e., above the tangential plane thereof, in which light strip 50 is located. Excepted therefrom are the regions of light beam 5 directed from the light source to roll 1 and of light beam 25 reflected from roll 1, which are shown shaded in the drawing. In an angularly displaced plane, the light sensor 6-8 may be arranged anywhere. It is only necessary to ensure that the light sensor 6–8 measures the stray light forming on a yarn or a yarn wind and not the light beam reflected from roll 1 itself, and that clear differences in light intensity can be detected as deviation of a photocurrent.

I claim:

1. A method of detecting a yarn lap in a strand of yarn which continuously advances across a rotating roll, comprising the steps of directing a light beam from a light source onto the surface of the rotating roll in a generally axial direction and at an acute angle with respect to the surface of the rotating roll, said light beam having a cross section defining a monitoring range on the surface of the rotating roll which is composed of a narrow light strip which extends axially along a portion of the surface of the rotating roll which is not looped by the advancing strand of yarn, wherein said light beam is reflected from the monitoring range along a predetermined path, and sensing stray light which is reflected from said yarn lap formed on the rotating roll by means of a light sensor positioned at a location outside of the light beam and outside of the predetermined path of the reflected light.

2. The method as in claim 1 wherein the light strip has a width of less than 5 mm.

3. The method as in claim 1 wherein the light beam is directed at the surface of the roll at an angle of incidence $\alpha$ of between 3° and 8°.

4. The method as in claim 1 wherein the light beam comprises a monochromatic light.

5. The method as in claim 1 wherein the light source comprises a source of laser light.

6. The method as in claim 1 comprising the further step of directing a second light beam from a second light source onto the surface of the roll in a generally axial direction which is opposite the axial direction of the first mentioned light beam and at an acute angle with respect to the surface of the roll, with the second light beam having a cross section so as to define a monitoring range on the surface of the roll which is composed of a narrow light strip which extends axially along the surface of the roll and overlaps the monitoring range of the first mentioned light beam, and such that the second light beam is reflected from its monitoring range along a second predetermined path, and wherein the light sensor is positioned at a location outside of the second light beam and outside of the second predetermined path.

7. The method as in claim 1 wherein the light sensor is located above substantially the center of the monitoring range.

8. The method as in claim 1 comprising the further step of releasing an alarm signal whenever the sensed stray light exceeds a predetermined level.

9. A yarn processing apparatus comprising a roll rotating about its axis, means for guiding a strand of yarn which continuously advances across said rotating roll, a light source for directing a light beam at an acute angle with respect to the surface of the rotating roll, said light beam having a cross section defining a monitoring range on the surface of said rotating roll wherein said cross section is a narrow light strip extending axially along a portion of the surface of the rotating roll which is not looped by said strand of yarn, wherein said light beam is reflected from the monitoring range along a predetermined path, and a light sensor positioned at a location outside of the light beam and outside of the predetermined path of the reflected light to sense stray light which is reflected from a yarn lap formed in the strand of yarn advancing across the rotating roll.

10. The apparatus as in claim 9 wherein the angle of incidence $\alpha$ between the light source and the axis of rotation of the roll is between 3° to 10°.

11. The apparatus as in claim 9 wherein the light beam comprises monochromatic light.

12. The apparatus as in claim 9 further comprising a second light source for directing a second light beam onto the surface of the roll in a generally axial direction which is opposite the axial direction of the first mentioned light beam and at an acute angle with respect to the surface of the roll, with the second light beam having a cross section so as to define a monitoring range on the surface of the roll which is composed of a narrow light strip which extends axially along the surface of the roll and overlaps the monitoring range of the first mentioned light beam, and such that the second light beam is reflected from its monitoring range along a second predetermined path, and wherein the light sensor is positioned at a location outside of the second light beam and outside of the second predetermined path.

13. The apparatus as in claim 9 wherein the light sensor includes a photodiode.

14. The apparatus as in claim 9 wherein a convergent lens is positioned between the roll and the light sensor.

15. The apparatus as in claim 14 wherein the roll includes a plurality of thrust rings formed thereon in an axially spaced relation, and wherein a mask is arranged between the convergent lens and the light sensor so as to gate out the region outside a pair of the thrust rings.

16. The apparatus as in claim 9 wherein the light sensor is arranged in a plane parallel to a plane defined by the light beam from the light source to the roll.

17. The apparatus as in claim 9 wherein the light source is positioned outside of the axial length of said roll.

* * * * *